US005551901A

United States Patent [19]

Jaeger

[11] Patent Number: 5,551,901

[45] Date of Patent: Sep. 3, 1996

[54] BUOYANT WATER COURSE MARKER

[76] Inventor: Eduard A. Jaeger, 16844 Margate St., Encino, Calif. 91436

[21] Appl. No.: 315,600

[22] Filed: Sep. 30, 1994

[51] Int. Cl.[6] ..... B63B 22/16

[52] U.S. Cl. ..... 441/6

[58] Field of Search ..... 24/129 R, 129 B, 24/130; 441/1, 6, 20, 21–32; 114/294

[56] References Cited

U.S. PATENT DOCUMENTS

| | | | |
|---|---|---|---|
| 2,163,795 | 6/1939 | Merralls | 441/30 |
| 2,917,755 | 12/1959 | Peck | 441/30 |
| 3,555,626 | 1/1971 | Terada | 24/130 |
| 3,742,535 | 7/1973 | Horror et al. | 441/23 |
| 4,355,444 | 10/1982 | Haney | 24/129 B |
| 4,913,672 | 4/1990 | Martin | 441/40 |
| 5,342,229 | 8/1994 | Whitt | 441/6 |

OTHER PUBLICATIONS

Pp. 107–112 of May 1991 Water Ski Magazine, "How To Install a Slalom Course".

*Primary Examiner*—Edwin L. Swinehart
*Attorney, Agent, or Firm*—Lewis Anten, Esq.; Amede Ferraro, Esq.

[57] ABSTRACT

A buoyant device used as a marker in the water for use in water sports is disclosed. The buoyant device comprises an inflatable buoyant member having one end coupled to an elastic cord which is coupled to an accompanying anchoring bag that is weighted down. The overall length of the elastic cord is varied according to the depth of the water with a self-locking length adjusting device used to vary the overall length of the elastic cord to eliminate any slack in the elastic cord in shallow waters in which the depth is less than the overall length of the elastic cord and when water currents change.

26 Claims, 2 Drawing Sheets

12
14
16

12
18

20

10
44
A 10
12
16
20
36
28
26
30
24
22

BUOYANT WATER COURSE MARKER

BACKGROUND OF THE INVENTION

1. Field of the Invention

The present invention relates to the field of buoyant devices, and more particularly to buoys used to mark the boundaries of a water course in water sports.

2. Description of the Related Art

Buoyant markers are widely used to mark an area or areas of a body of water in order to define a course for water sports such as jet ski racing, water skiing, or other watercraft sports. Typically, the buoyant part of the marker is anchored in a fixed position by being coupled to a stationary object such as the ocean floor or the side of a pool. The fixing of the marker to the floor of an ocean or lake involves considerable time and expense in that a heavy anchor, such as a block of concrete, must be dropped into the water at a desired location, which is burdensome and time consuming. In a pool, the marker must be attached to either the floor or the side of the pool involving possible structural modifications to the pool itself.

The buoyant markers of the past proved problematic in that once the marker was placed in a body of water, it was either permanent or involved a great deal of effort to relocate. Usually, the relocation process required retrieving a sunken cement block from the ocean floor or the unfastening of a marker attached to a pool. This caused a difficult problem especially when the water conditions would shift and the markers could not be easily moved to compensate and adjust to the change in water conditions.

In attempts to solve such problems, buoyant water markers comprising a buoyant member coupled to a fixed length cord attached to a anchoring bag have been developed in the past. However, these buoyant water markers were not capable of being easily adjusted to compensate for variable water conditions such as different water depths and changing water currents. In different water depths that were substantially less than the fixed length of the cord, the slack in the cord was a potential hazard as it had the potential of interfering with water skiers or of being caught in the motors of the jet skis or other watercraft. In great water depths, a cord of considerable length was required to reach the floor leading to increased expense and unwieldy bulk. Further, the slack present in the cord when the water depth was less than the fixed cord length made the precise placement of the water marker difficult, as the amount of slack in the cord had to be taken into consideration to determine the correct placement of the weighted bag in order to keep the buoyant marker in the desired location.

Therefore, at present there exists a need for a buoyant water course marker that may be easily placed in a fixed position in a body of water which may be easily adjusted to meet variable water conditions, such as water depth and changing water currents, and may be reused repeatedly.

SUMMARY OF THE INVENTION

The buoyant water course marker of the present invention comprises an inflatable buoyant barrel having an airtight inner chamber. The buoyant barrel has one end coupled to a variable length elastic cord which is coupled to an anchoring bag. The anchoring bag is filled with a weighted material, such as rocks or sand, to weight the bag down in the water. The length of the elastic cord may be varied according to the depth of the water in which the buoyant water course marker is placed. When the anchoring bag is immersed in the water, and sinks to the bottom, a downward force is exerted on the elastic cord and the buoyant barrel such that the elastic cord becomes stretched. As the buoyant barrel floats on the surface of the water, the tension of the elastic cord maintains the buoyant barrel in a relatively stationary position near the surface of the water. A self-locking cord length adjuster is used to shorten the length of the elastic cord to eliminate any excess length in the elastic cord for use in shallow waters in which the depth is less than the unstretched length of the elastic cord and when water currents change.

The present invention provides an economical, practical and simple buoyant water course marker which can easily be placed in any body of water to mark boundaries for use in water sports. Once the course has been marked, the buoyant water course marker can easily be moved to change the boundaries without employing the effort and expense required the markers of the past.

DETAILED DESCRIPTION OF THE DRAWINGS

Figures 1, 2, 3, 7, 8:
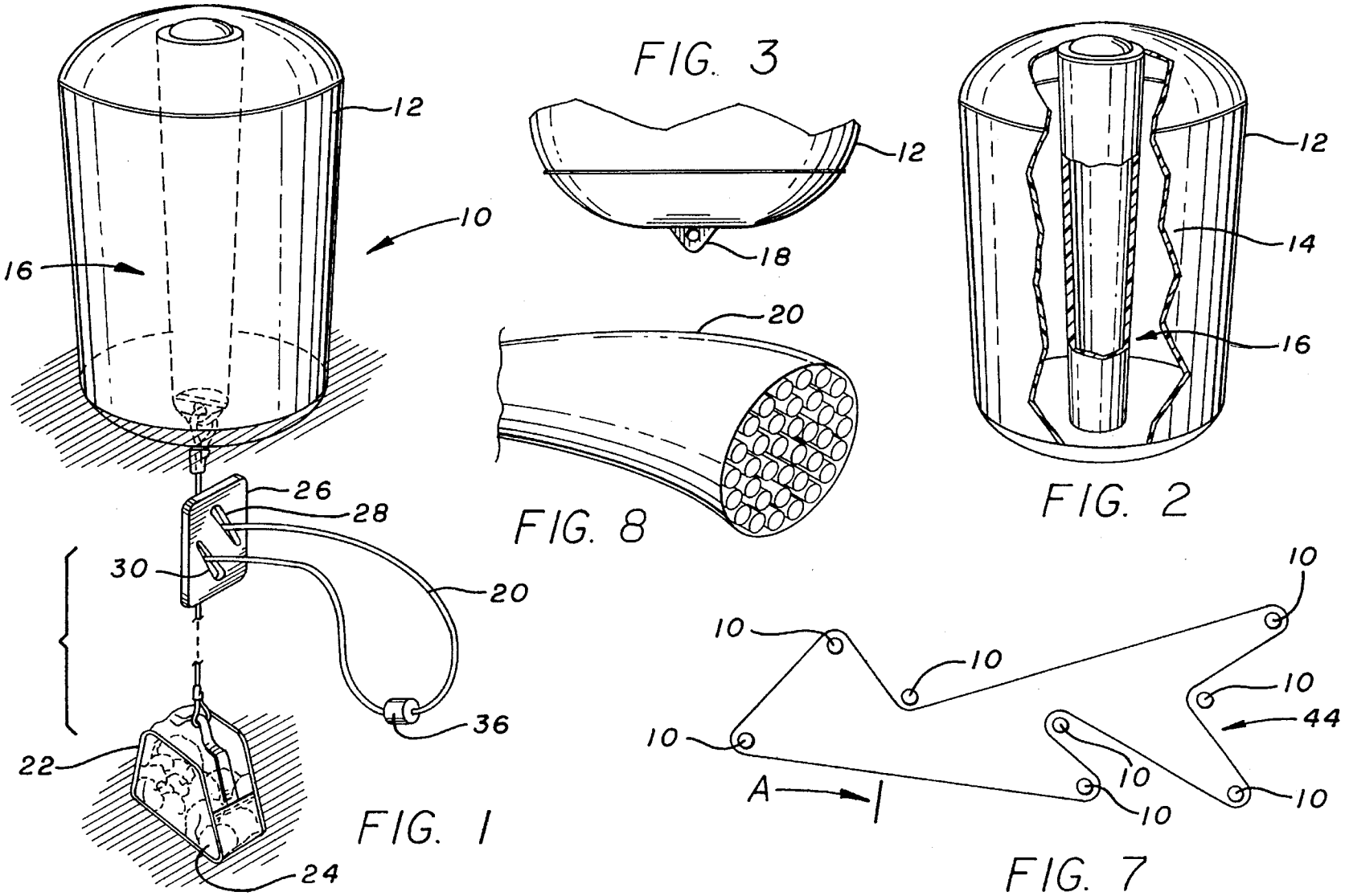
FIG. 1 is a front perspective view of the buoyant water course marker of the present invention with the interior of the inflatable buoyant barrel and the contents of the anchoring bag shown in hidden line.
FIG. 2 is an elevational side view of the buoyant barrel of the buoyant water course marker of FIG. 1 shown in partial cutaway.
FIG. 3 is a fragmented front perspective view of the buoyant barrel of the buoyant water course marker of FIG. 1.
FIG. 7 is a schematic representation of a water course created in a body of water with a plurality of buoyant water course markers of the present invention with the direction of travel indicated by arrow A.
FIG. 8 is an enlarged perspective end view of a segment of the elastic cord of the present invention with one end shown in cross section to illustrate the inner core of elastic fibers surrounded by woven nylon.

Referring to FIGS.1--3, a buoyant water course marker embodying the features of the present invention is shown and generally referred to by the number 10. The buoyant water course marker 10 comprises an inflatable buoyant barrel 12 having an outer wall 14 surrounding an airtight inner chamber 16. The buoyant barrel 12 has one end having an eyelet 18 through which an elastic cord 20 can pass. The buoyant barrel 12 is coupled via eyelet 18 to the elastic cord 20 which in turn is coupled to an anchoring bag 22. The anchoring bag 22 is filled with a weighted material 24, such as sand or rocks, to add weight to the anchoring bag 22 such that it sinks in the water.

When the weighted anchoring bag 22 is immersed in the water and sinks to the bottom, a downward force is exerted on the elastic cord 20 and on the buoyant barrel 12 such that the elastic cord 20 becomes stretched. As the buoyant barrel 12 floats on the surface of the water, the tension of the elastic cord 20 maintains the buoyant barrel 12 in a relatively stationary position at the surface of the water. The overall length of the elastic cord 20 may be varied according to the depth of the water. In the preferred embodiment, the length of the elastic cord 20 is approximately 20 feet, in its unstretched state and may be stretched up to three times to approximately 60 feet. In the preferred embodiment, the elastic cord 20 comprises an elastic fiber core with a wound nylon exterior wrapping, commonly known as a bungee cord and commercially available from Bungee International Mfg., Inc., Chatsworth, Calif.

Figures 4, 5, 6:
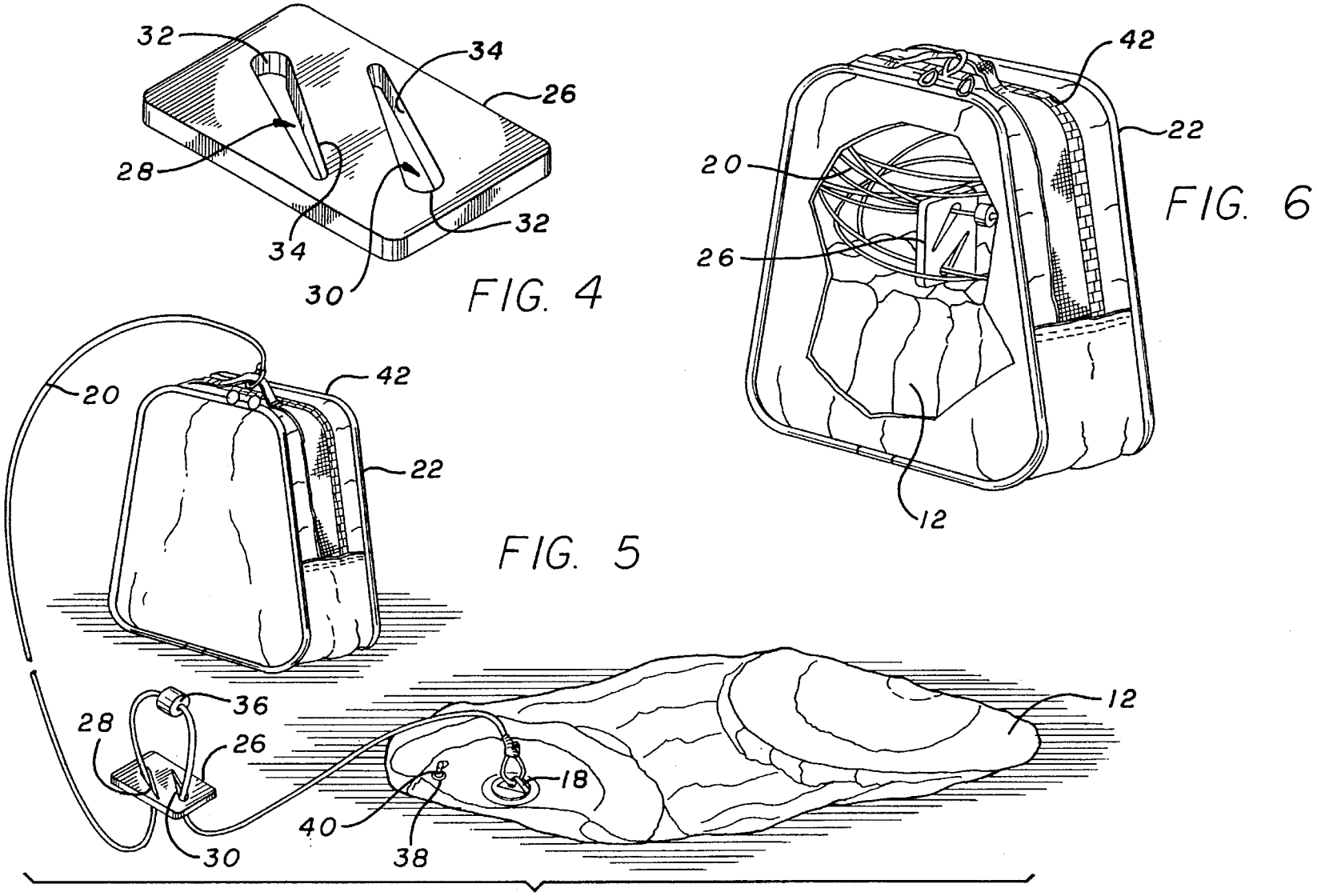
FIG. 4 is a top perspective view of the cord length adjuster of the buoyant water course marker of FIG. 1.
FIG. 5 is a front perspective view of the buoyant water course marker of FIG. 1 with the buoyant barrel shown in a deflated state.
FIG. 6 is front perspective view of the buoyant water course marker of FIG. 1 with a deflated buoyant barrel and elastic cord collapsed and stored within the anchoring bag shown in partial cut away.

Referring to FIG. 4, a top perspective view of the cord length adjuster 26 is shown. The cord length adjuster 26 comprises a generally rectangular and flat block having a first slot 28 and second slot 30. The first and second slots 28 and 30 are identical and are oriented 180 degrees with respect to each other in the middle of the cord length adjuster 26. Each of the first and second slots 28 and 30 have a rounded portion 32 which has a width slightly greater than the diameter of the elastic cord 20 and an angled portion 34 which decreases in width in the direction away from the rounded portion 32. The elastic cord 20 is fed through the rounded portion 32 of each of the first and second slots 28 and 30 wherein the elastic cord 20 can freely move. To prevent the movement of the elastic cord 20 through the first and second slots 28 and 30, the elastic cord 20 is slid in a direction away from the rounded portion 32 into the angled portion 34 wherein the elastic cord 20 becomes wedged since the width of the angled portion 34 is less than the diameter of the elastic cord 20. The cord length adjuster 26 is also self-locking as the downward forces exerted on the elastic cord 20 by the anchoring bag 22 further wedges the elastic cord 20 within the first slot 28 such that the elastic cord 20 is more firmly held within the first slot 28. Similarly, the upward force exerted on the elastic cord 20 by the floating buoyant barrel 12 further wedges the elastic cord 20 with the second slot 30 such that the elastic cord 20 is more firmly held within the second slot 30.

The cord length adjuster 26 is used to vary the length of the elastic cord 20 in order to eliminate any slack created in the elastic cord 20 when the buoyant water course marker 10 is used in shallow waters in which the water depth is less than the overall length of the elastic cord 20. The overall length of the elastic cord 20 is varied by increasing or decreasing the portion of elastic cord 20 present between the first and second slots 28 and 30. The greater the amount of elastic cord 20 that is present between the first and second slots 28 and 30 the shorter is the overall length of the elastic cord 20.

In the preferred embodiment the elastic cord 20 is threaded through a weighted bead 36, preferably made of lead, which is located in the portion of the elastic cord 20 present between the first and second slots 28 and 30. The weighted bead 36 functions to keep the portion of the elastic cord 20 present between the first and second slots 28 and 30 away from the water surface such that it does not interfere with any activity or watercraft on the water surface.

Referring to FIG. 5, the buoyant water course marker 10 is shown with the buoyant barrel 12 in a deflated state. The outer wall 14 has an opening 38 with a conventional valve 40 for inflating and deflating the inner chamber 16. In the preferred embodiment, anchoring bag 22 is made of a nylon material capable of withstanding the corrosive effects of water. A reclosable opening 42 located at the top of the anchoring bag 22 provides access to the interior of the anchoring bag 22 for the insertion of the weighted material 6 such as rocks or sand, into the anchoring bag 22. In this manner, a weighted material that is readily available and naturally present near bodies of water may be utilized to add weight to the anchoring bag 22 eliminating the need for transporting a weighted anchor to the body of water. Once the weighted material 26 is placed within the anchoring bag 22, the opening 42 is closed.

Referring FIG. 6 the buoyant water course marker 10 with buoyant barrel 12 in a deflated state and the elastic cord 20 may be stored within the anchoring bag 22 for easy stowing and carrying. The opening 42 is of a sufficient size to facilitate the insertion and removal of the buoyant barrel 12 and the elastic cord 20 from the anchoring bag 22. Once the buoyant barrel 12 and the elastic cord 20 are inserted within the anchoring bag 22, the opening 42 is closed such that the anchoring bag 22 serves to store and facilitate transportation of the buoyant water course marker 10.

Referring to FIG. 7, a plurality of buoyant water course markers 10 may be placed in a body of water to create a water course 44. The water course 44 may be used for racing or training with jet skis, water skis, or other watercraft. The direction of travel along the water course 44 is indicated by arrow "A". The position of the buoyant water course markers 10 may be varied to increase the difficulty of the water course 44 as can the number of buoyant water course markers 10 used. It is appreciated that the possible combinations of buoyant water course markers 10 are infinite.

The buoyant water course marker 10 provides an economical, practical and simple buoyant water course marker which can be easily placed in any body of water to mark boundaries for use in water sports. Once the course has been marked, the buoyant water course marker 10 can easily be moved to change the boundaries without employing the effort and expense of the markers in the past.

While the present invention has been described in detail with regards to the preferred embodiment, it is appreciated that other variations of the present invention may be devised which do not depart form the inventive concept of the present invention.

What is claimed is:

1. In a buoyant water marker for marking a water course in a body of water having an inflatable buoyant member and an anchoring means, the improvement comprising:

an elastic cord of variable length having one end removably coupled to said buoyant member and its other end removably coupled to said anchoring means, said elastic cord comprising a stretchable material having a length that is substantially greater in a stretched state than in an unstretched state, said anchoring means being portable; and self-locking cord length adjusting means for varying the length of said cord according to the depth of the body of water, said cord length adjusting means being positioned proximate said buoyant member and proximate the surface a body of water.

2. The buoyant water marker of claim 1 in which said cord length adjusting means comprises a block member having a first slot with a first rounded portion and first angled portion, a second slot having a first rounded portion and second angled portion, said first slot oriented 180 degrees to said second slot, an excess portion of said elastic cord is present between said first and second slots, whereby the overall length of said elastic cord is adjusted by varying the length of said excess portion.

3. The buoyant water marker of claim 2 in which said first and said second rounded portion have a diameter slightly greater than the diameter of said elastic cord.

4. The buoyant water marker of claim 3 in which said first and said second angled portions have a width that is less than the diameter of said elastic cord.

5. The buoyant water marker of claim 1 in which said elastic cord comprises an inner core of elastic fibers surrounded by woven nylon material.

6. The buoyant water marker of claim 1 in which said elastic cord is capable of being stretched to at least twice its unstretched length.

7. The buoyant water marker of claim 2 further including a weighted bead for maintaining said excess portion of said elastic cord away from the surface of said body of water.

8. The buoyant water marker of claim 1 in which said buoyant member is collapsible when deflated, said anchoring means comprising means for storing said inflatable buoyant member in a collapsed state within said anchoring means.

9. The buoyant water marker of claim 1 in which said anchoring means comprises a bag for containing weighted material therein, said bag including means for storing said buoyant member in a deflated state and said elastic cord within said bag.

10. A buoyant water marker set for marking a water course in a body of water wherein each buoyant water marker has an inflatable buoyant member and an anchoring means, the improvement comprising:

a plurality of elastic cords each having one end removably coupled to one of said plurality of buoyant members and a second end removably coupled to one of said plurality of anchoring means, each of said plurality of elastic cords comprising a stretchable material having a length that is substantially greater in a stretched state than in an unstretched state, said anchoring means being portable; and a plurality of self-locking cord length adjusting means for varying the length of said cord according to the depth of the body of water, said cord length adjusting means being positioned proximate said buoyant member and proximate the surface a body of water.

11. The buoyant water marker of claim 10 in which said cord length adjusting means comprises a block member having a first slot with a first rounded portion and first angled portion, a second slot having a first rounded portion and second angled portion, said first slot oriented 180 degrees to said second slot, an excess portion of said elastic cord is present between said first and second slots, whereby the overall length of said elastic cord is adjusted by varying the length of said excess portion.

12. The buoyant water marker of claim 11 in which said first and said second rounded portion have a diameter slightly greater than the diameter of said elastic cord.

13. The buoyant water marker of claim 12 in which said first and said second angled portions have a width that is less than the diameter of said elastic cord.

14. The buoyant water marker of claim 10 in which said elastic cord comprises an inner core of elastic fibers surrounded by woven nylon material.

15. The buoyant water marker of claim 10 in which said elastic cord is capable of being stretched to at least twice its unstretched length.

16. The buoyant water marker of claim 11 further including a weighted bead for maintaining said excess portion of said elastic cord away from the surface of said body of water.

17. The buoyant water marker of claim 10 in which said buoyant member is collapsible when deflated, said anchoring means comprising means for storing said inflatable buoyant member in a collapsed state within said anchoring means.

18. The buoyant water marker of claim 10 in which said anchoring means comprises a bag for containing weighted material therein, said bag including means for storing said buoyant member in a deflated state and said elastic cord within said bag.

19. In a buoyant water marker for marking a water course in a body of water having an inflatable buoyant member and an anchoring means, the improvement comprising:

an elastic cord of variable length having one end removably coupled to said buoyant member and its other end removably coupled to said anchoring means; and cord length adjusting means for varying the length of said cord according to the depth of the body of water, said cord length adjusting means comprising a block member having a first slot with a first rounded portion and first angled portion, a second slot having a first rounded portion and second angled portion, said first slot oriented 180 degrees to said second slot, an excess portion of said elastic cord is present between said first and second slots, whereby the overall length of said elastic cord is adjusted by varying the length of said excess portion.

20. The buoyant water marker of claim 19 in which said first and second rounded portion have a diameter slightly greater than the diameter of said elastic cord.

21. The buoyant water marker of claim 20 in which said first and said second angled portions have a width that is less than the diameter of said elastic cord.

22. In a buoyant water marker for marking a water course in a body of water having an inflatable buoyant member and an anchoring means, the improvement comprising:

an elastic cord of variable length having one end removably coupled to said buoyant member and its other end removably coupled to said anchoring means;

cord length adjusting means for varying the length of said cord according to the depth of the body of water, said cord length adjusting means comprising a block member having a first slot with a first rounded portion and first angled portion, and a second slot having a first rounded portion and second angled portion, said first slot oriented 180 degrees to said second slot, an excess portion of said elastic cord is present between said first and second slots, whereby the overall length of said elastic cord is adjusted by varying the length of said excess portion; a weighted bead for maintaining said excess portion of said elastic cord away from the surface of said body of water.

23. A buoyant water marker set for marking a water course in a body of water wherein each buoyant water marker is of the type having an inflatable buoyant member and an anchoring means, the improvement comprising:

a plurality of elastic cords each having one end removably coupled to one of said plurality of buoyant members and a second end removably coupled to one of said plurality of anchoring means; and a plurality of cord length adjusting means for varying the length of said cord according to the depth of the body of water, said cord length adjusting means comprising a block member having a first slot with a first rounded portion and first angled portion, a second slot having a first rounded portion and second angled portion, said first slot oriented 180 degrees to said second slot, an excess portion of said elastic cord is present between said first and second slots, whereby the overall length of said elastic cord is adjusted by varying the length of said excess portion.

24. The buoyant water marker of claim 23 in which said first and said second rounded portion have a diameter slightly greater than the diameter of said elastic cord.

25. The buoyant water marker of claim 24 in which said first and said second angled portions have a width that is less than the diameter of said elastic cord.

26. The buoyant water marker of claim 23 further including a weighted bead for maintaining said excess portion of said elastic cord away from the surface of said body of water.

* * * * *